US010748356B1

(12) United States Patent
Herron et al.

(10) Patent No.: US 10,748,356 B1
(45) Date of Patent: Aug. 18, 2020

(54) VEHICLE DIAGNOSTIC AND PROGRAMMING DEVICE AND METHOD

(71) Applicant: Drew Technologies, Inc., Ann Arbor, MI (US)

(72) Inventors: Brian J. Herron, Dexter, MI (US); Michael L. Drew, Dexter, MI (US); David Baartman, Canton, MI (US); Gus Nassar, Canton, MI (US); Mark Wine, Ann Arbor, MI (US)

(73) Assignee: Drew Technologies, Inc., Ann Arbor, MI (US)

( * ) Notice: Subject to any disclaimer, the term of this patent is extended or adjusted under 35 U.S.C. 154(b) by 274 days.

(21) Appl. No.: 15/651,351

(22) Filed: Jul. 17, 2017

(51) Int. Cl.
*G07C 5/08* (2006.01)
*G07C 5/00* (2006.01)

(52) U.S. Cl.
CPC ..... *G07C 5/0808* (2013.01); *G07C 5/008* (2013.01)

(58) Field of Classification Search
CPC ..... G07C 5/0808; G07C 5/008
See application file for complete search history.

(56) References Cited

U.S. PATENT DOCUMENTS 5,491,418 A 2/1996 Alfaro et al.
5,835,873 A * 11/1998 Darby ..... B60R 21/01 701/45
6,728,603 B2 4/2004 Pruzan et al.
6,928,349 B1 8/2005 Namaky et al.
6,956,501 B2 10/2005 Kitson
7,092,803 B2 8/2006 Kapolka et al.
7,519,458 B2 4/2009 Buckley
7,532,962 B1 * 5/2009 Lowrey ..... G01M 15/04 340/438
7,584,030 B1 9/2009 Graham
7,786,851 B2 8/2010 Drew et al.
7,928,837 B2 4/2011 Drew et al.
8,190,322 B2 5/2012 Lin et al.
8,339,254 B2 12/2012 Drew et al.
D675,568 S 2/2013 Drew et al.
8,638,207 B2 1/2014 Drew et al.
D701,832 S 4/2014 Drew et al.
8,688,313 B2 4/2014 Margol et al.
D718,201 S 11/2014 Drew et al.
D725,519 S 3/2015 Drew et al.

(Continued)

OTHER PUBLICATIONS

Commonly assigned co-pending U.S. Appl. No. 15/446,744, filed Mar. 1, 2017, entitled Remote Diagnostic System and Method.

(Continued)

*Primary Examiner* — Russell Frejd
(74) *Attorney, Agent, or Firm* — Gardner, Linn, Burkhart & Ondersma LLP

(57) ABSTRACT

A method and system of diagnosing and/or programming a vehicle with a vehicle interface device that is configured to operate on a predetermined use basis. The vehicle interface device is operatively connected with one or more electronic control units of a vehicle via a diagnostic port of the vehicle. The interface device is enabled to be operable to diagnose and/or program a vehicle for a predetermined use, such as by receiving an activation signal. The vehicle interface device is subsequently disabled from operating to diagnose and/or program a vehicle upon the vehicle interface device operating for the predetermined use.

27 Claims, 5 Drawing Sheets

(56) References Cited

U.S. PATENT DOCUMENTS

| | | | | |
|---|---|---|---|---|
| 9,432,347 | B2 * | 8/2016 | Thoppae | H04L 63/08 |
| 9,530,255 | B2 | 12/2016 | Drew et al. | |
| 9,840,228 | B2 * | 12/2017 | Bartoszewski | B60R 16/037 |
| 10,316,812 | B2 * | 6/2019 | Sankavaram | G01M 15/05 |
| 2005/0251304 | A1 | 11/2005 | Cancellara et al. | |
| 2006/0130033 | A1 * | 6/2006 | Stoffels | G06F 8/61 717/166 |
| 2006/0202862 | A1 | 9/2006 | Ratnakar | |
| 2006/0211446 | A1 | 9/2006 | Wittmann et al. | |
| 2006/0217855 | A1 | 9/2006 | Chinnadurai et al. | |
| 2007/0043488 | A1 * | 2/2007 | Avery | G01R 31/007 701/33.2 |
| 2007/0050105 | A1 | 3/2007 | Chinnadurai et al. | |
| 2007/0185624 | A1 | 8/2007 | Duddles et al. | |
| 2008/0280602 | A1 * | 11/2008 | Ban | G06F 21/572 455/420 |
| 2009/0119657 | A1 | 5/2009 | Link, II | |
| 2009/0265055 | A1 | 10/2009 | Gillies | |
| 2011/0153150 | A1 | 6/2011 | Drew et al. | |
| 2011/0313593 | A1 * | 12/2011 | Cohen | G01S 5/0027 701/2 |
| 2012/0046826 | A1 * | 2/2012 | Panko | G07C 5/0808 701/33.3 |
| 2014/0086242 | A1 | 3/2014 | Drew et al. | |
| 2014/0121894 | A1 | 5/2014 | Drew et al. | |
| 2014/0121937 | A1 | 5/2014 | Drew et al. | |
| 2014/0172230 | A1 | 6/2014 | Drew et al. | |
| 2014/0297099 | A1 | 10/2014 | Drew et al. | |
| 2014/0309905 | A1 | 10/2014 | Drew et al. | |
| 2017/0172397 | A1 | 6/2017 | Zardini | |
| 2018/0101775 | A1 * | 4/2018 | Fish | G06Q 10/04 |

OTHER PUBLICATIONS

Commonly assigned co-pending U.S. Appl. No. 15/485,531, filed Apr. 12, 2017, entitled Vehicle Programming and Diagnostic Device With Integrated Battery Charger.

Commonly assigned co-pending U.S. Appl. No. 15/485,643, filed Apr. 12, 2017, entitled Battery Charger With Projecting Members.

Commonly assigned co-pending U.S. Appl. No. 29/600,447, filed Apr. 12, 2017, entitled Vehicle Diagnostic Device.

* cited by examiner

VEHICLE DIAGNOSTIC AND PROGRAMMING DEVICE AND METHOD

BACKGROUND OF THE INVENTION

The present invention is directed to a vehicle diagnostic and/or programming tool, and in particular to operational use of such a tool by a technician.

In automotive repair garages, many of the tools used to diagnose and repair cars have transitioned to computer-based systems. Many of these diagnostic systems include an Internet-connected, off-the-shelf diagnostic computer running an operating system such as Microsoft Windows, and contain an installed and licensed diagnostic application(s) that was developed by an automotive manufacturer, such as Ford, or a diagnostic company, such as Snap-on. The diagnostic systems can be expensive, with each automotive manufacturer suppling its own proprietary diagnostic application software, such that the interface device must be able to receive and transmit various electronic communications for maintaining various vehicles.

SUMMARY OF THE INVENTION

The present invention provides a vehicle diagnostic and/or programming tool or interface device, and in particular an interface device that operates on a predefined use basis whereby a technician may use the interface device for vehicle maintenance and repair as needed.

According to an aspect of the present invention, a method of diagnosing and/or programming a vehicle comprises providing a vehicle interface device that is configured to operate for on a predetermined use basis. The vehicle interface device is connected with a diagnostic port of a vehicle to be in communication with an electronic control unit of the vehicle, with electrical power supplied to the vehicle interface device. The vehicle interface device is separately enabled to be operable to diagnose and/or program a vehicle for a predetermined use. The vehicle interface device is subsequently disabled from operating to diagnose and/or program a vehicle upon the vehicle interface device operating for the predetermined use.

In particular embodiments the vehicle interface device is enabled to operate to be operable to diagnose and/or program a vehicle by receiving an activation signal. Still further, the vehicle interface device may include an operator interface, such as a screen and a touchpad, configured to enable an operator to input codes to the interface device. The vehicle interface device may be configured to be enabled to diagnose and/or program a vehicle upon transmitting an activation signal to the vehicle interface via the operator interface.

The predetermined use may be based on time whereby operation of the vehicle interface device to diagnose and/or program vehicles is limited to a predetermined duration of time. Alternatively, the predetermined use may be based on a predetermined number of uses of the vehicle interface device to diagnose and/or program vehicles, with each time that the interface device is used on a vehicle constituting one of the predetermined number of uses. A control of the vehicle interface device may track the use of the device and disable the device for further diagnosing and/or programming upon the device having been used for the predetermined use basis.

In a still further configuration, electrical power may be removed from the vehicle interface device after it has been enabled for use to program and/or diagnose a vehicle, but prior to the interface device operating for the predetermined use, with the vehicle interface device subsequently being usable to program and/or diagnose a vehicle after power has been re-supplied to the interface device. In a particular embodiment a control of the vehicle interface device includes nonvolatile memory.

The vehicle interface device will receive signals from the electronic control units, with the receipt of the signals being detected by the vehicle interface device to confirm that it is connected to the vehicle. The detecting may be used as confirmation that the vehicle interface device is enabled to diagnose and/or program the vehicle.

A local computer is additionally operatively connected with the vehicle interface device, and in a particular embodiment the computer may transmit an activation signal to the vehicle interface device to enable the vehicle interface device to be operable to diagnose and/or program a vehicle. Still further, the local computer may be connected to a remote computer, with the remote computer transmitting an activation signal to the local computer to supply to the vehicle interface device.

According to a still further aspect of the invention, a vehicle diagnostic and/or programming system includes a vehicle interface device having a control, one or more vehicle protocols, and a computer interface. The vehicle interface device is operable to selectively diagnose and/or program a vehicle on a predetermined use basis, with the vehicle interface device being configured to cease being operable to diagnose and/or program a vehicle upon the vehicle interface device operating for the predetermined use. The vehicle interface device may include an operator interface, which may include a screen and/or a touchpad. In a particular embodiment the system includes a local computer that is operatively connected to the vehicle interface device with computer configured to enable an operator to diagnose and/or program the vehicle via the vehicle interface device. In a still further particular embodiment the vehicle interface device and local computer are integrated together, such as in a unitary housing or case.

The vehicle interface device of the present invention enables repair facilities to accurately and effectively diagnose vehicles for maintenance purposes, as well as reprogram vehicles, without having to invest significant capital in the purchase and maintenance of a vehicle interface device. The ability to selectively pay for and use an interface device in accordance with the present invention beneficially aids service and repair facilities in avoiding to invest significant capital in ownership and maintenance of a traditional interface tool, including for smaller and/or independent facilities that may only intermittently require use of an interface tool. Still further, particular configurations are provided in which the device is able to be enabled or activated without connecting to a remote server controlled by the supplier of the vehicle interface device, thus promoting the flexibility of the use of the interface device. These and other objects, advantages, purposes and features of this invention will become apparent upon review of the following specification in conjunction with the drawings.

DESCRIPTION OF THE PREFERRED EMBODIMENTS

Figure 1:
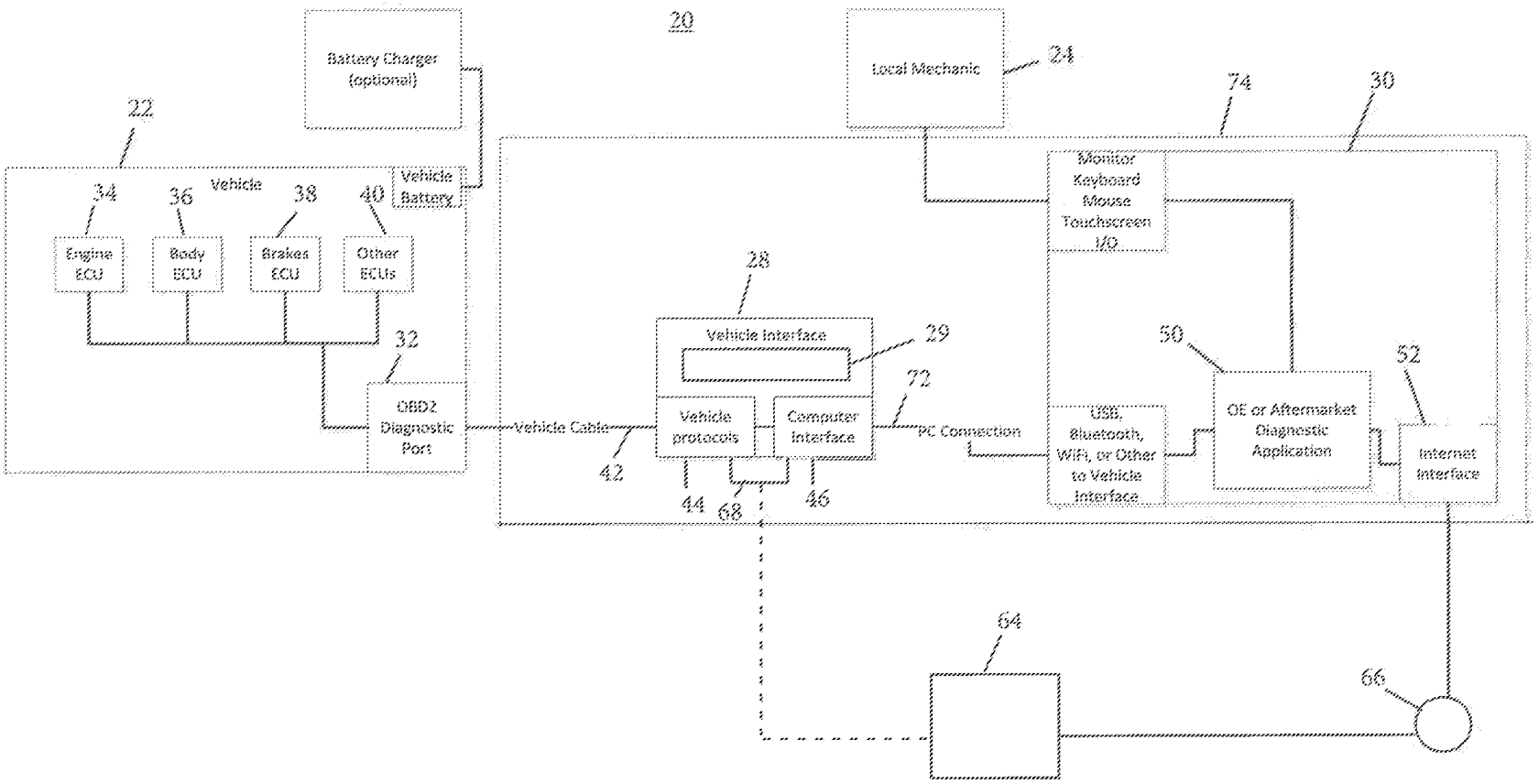
FIG. 1 is a block diagram of a vehicle programming and diagnostic interface device in accordance with the present invention shown in relation to a vehicle and computer device.

The present invention will now be described with reference to the accompanying figures, wherein the numbered elements in the following written description correspond to like-numbered elements in the figures. A vehicle diagnostic and programming system 20 for use with a vehicle 22 is shown for use by a mechanic or operator 24, such as in an automotive repair facility. System 20 is illustrated as including a vehicle diagnostic and programming tool, referred to as a vehicle interface device or interface tool 28, with interface tool 28 operatively connected with a local computer 30. In use, interface tool 28 is connected with vehicle 22 by operator 24, such as by connecting to an on-board diagnostic ("OBD") diagnostic port 32 of the vehicle 22 in order to diagnose and/or program various vehicle electronic control units (ECUs), such as an engine ECU 34, body ECU 36, brakes ECU 38, and/or other ECUs 40. Vehicle interface tool 28 connects with port 32, such as via vehicle cable 42. Vehicle interface tool 28 includes a control 29, such as in the form of a processor or micro-processor and interface circuitry to facilitate communication between the ECUs and the interface tool 28, with interface tool 28 including a database of vehicle protocols 44 that allow intelligent communication with the ECUs of each type of vehicle on the market. Vehicle interface tool 28 additionally includes a computer interface 46 for connection with computer 30, such as via standard interfaces, such as USB, Bluetooth, WiFi, or the like.

Figure 2:
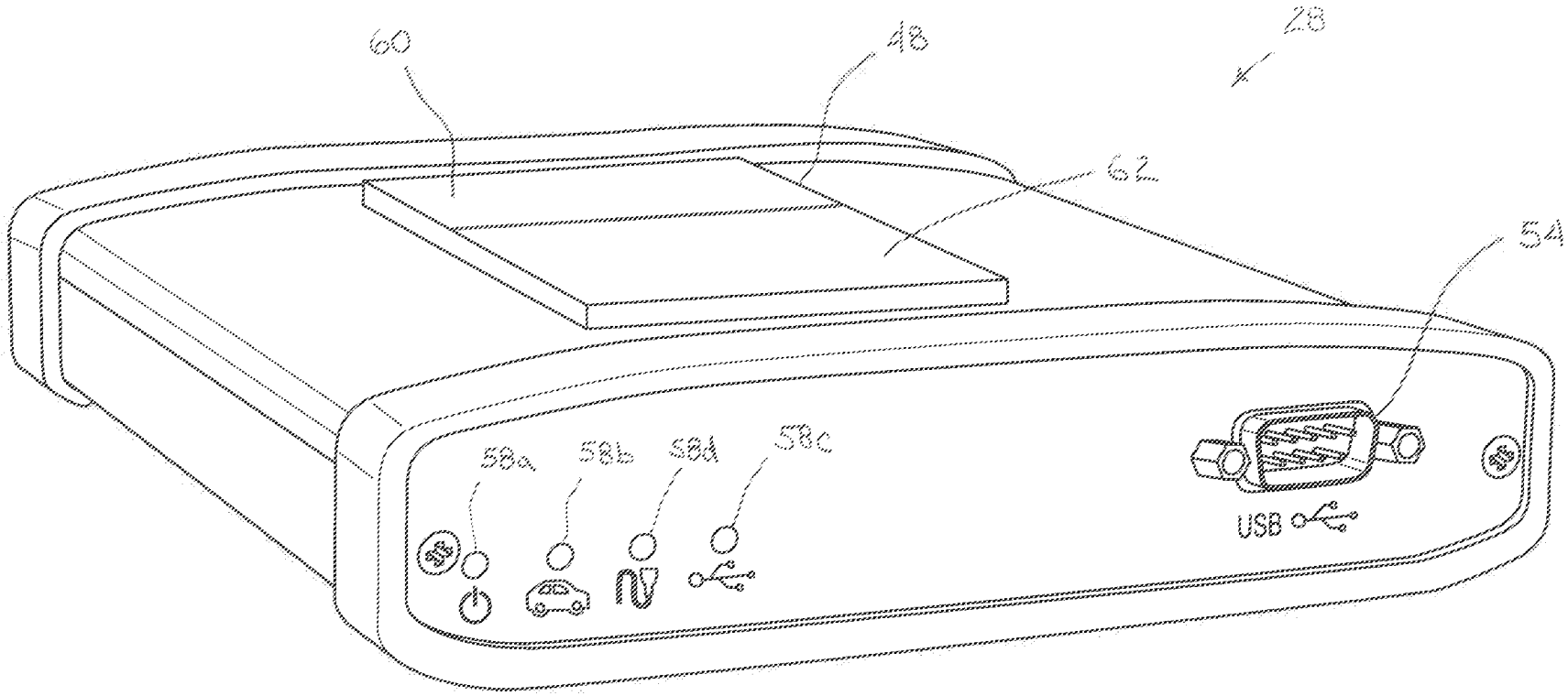
FIG. 2 is a front perspective view of a vehicle programming and diagnostic interface device in accordance with an aspect of the present invention.
Figure 3:
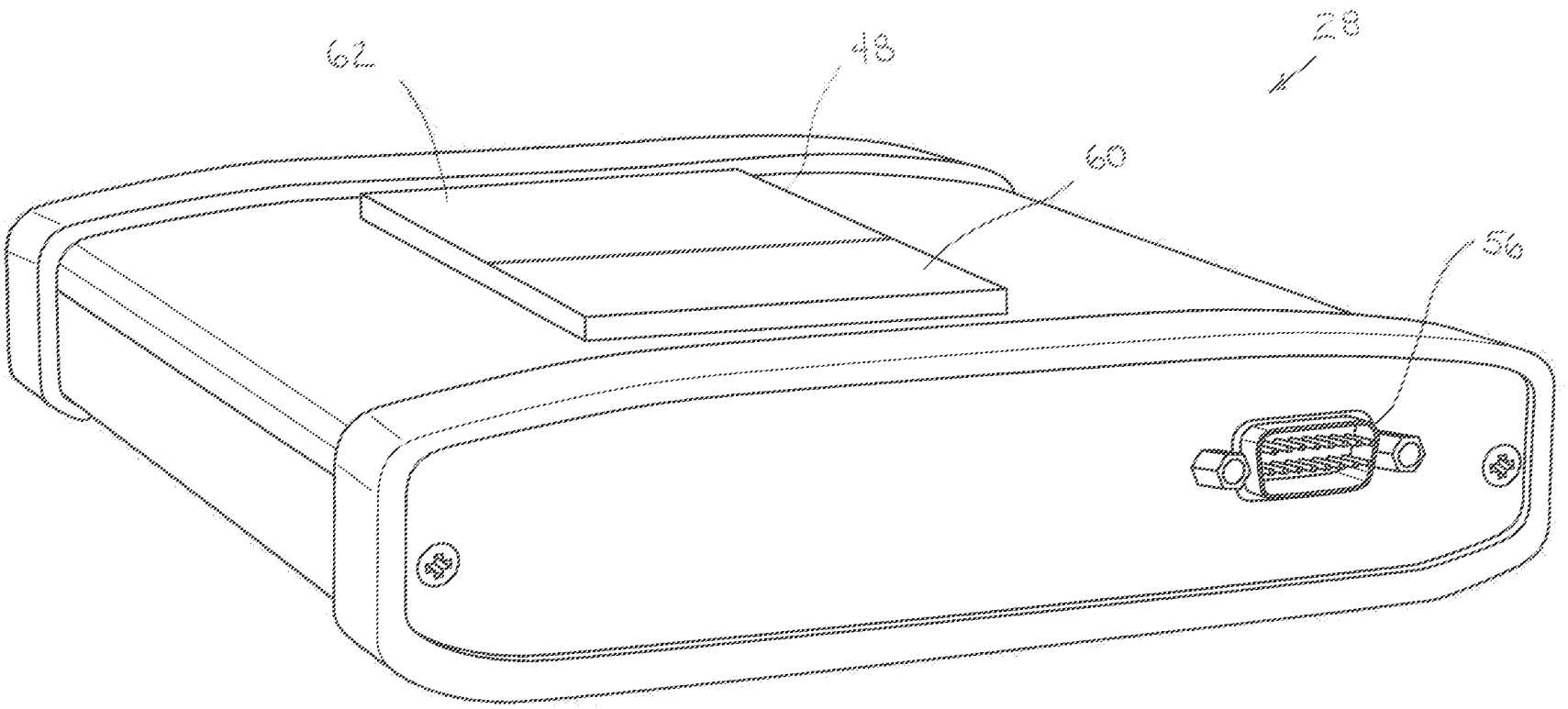
FIG. 3 is a rear perspective view of the interface device of FIG. 2.

Vehicle interface tool 28 is configured to be selectively activable to operate on a predefined use basis, whereby a technician may use the interface device for vehicle maintenance and repair as needed. In particular embodiments the predefined use basis may be a per use basis, may be timer based, or may be for a predefined number of uses, or may be subscription based for predefined time periods, such as for a day, week or month. As such, operator 24 may use interface tool 28 only as needed, and correspondingly pay for the use thereof only as needed. In the embodiment of FIGS. 2 and 3, vehicle interface tool 28 includes an operator interface 48 for selectively activating tool 28 by operator 24 for use in diagnosing and/or reprogramming a vehicle, such as vehicle 22. As discussed in more detail below, interface tool 28 may thus be preconfigured to operate on a predefined use basis, with operator 24 activating interface tool 28 for the predefined uses.

As noted, computer 30 is operatively connected with vehicle interface tool 28, with computer 30 including a commercially available diagnostic application program 50 that is configured for use with the specific vehicle under test. Diagnostic application program 50 comprises a program provided by an automotive manufacturer or a company that supplies diagnostic application programs, such as Snap-On Incorporated. In practice, computer 30 will include multiple diagnostic application programs 50 each for use with various makes and/or models of vehicles to enable diagnosing and programming of ECUs via interface tool 28. Alternatively and/or additionally, computer 30 may include a diagnostic application program that may be used with multiple variations of vehicles.

Computer 30 additionally includes an Internet interface 52 to provide a communication link to remotely located computers, such as remote computer or server 64. For example, computer 30 may, either in addition to the above noted various loaded diagnostic applications or in place thereof, be used to access remotely located diagnostic applications, such as that may reside on remotely located servers. This may be done, for example, to avoid the need for obtaining and locally storing and maintaining diagnostic applications on computer 30. In the illustrated embodiment, computer 30 is a laptop computer having a monitor, keyboard, mouse, and the like. The Internet interface 52 may either be integrated into computer 30 or attached to computer 30.

As noted interface tool 28 and computer 30 may be cooperatively used for diagnosing and/or programming ECUs of vehicle 22. Reprogramming, or re-flashing, of the ECUs may be done, for example, to update the ECUs with changes recommended and provided by the automobile manufacturer. Interface tool 28 and computer 30 are likewise used for accessing codes generated by the ECUs for assessing and diagnosing operational and performance related aspects of the vehicle. In the illustrated embodiment interface tool 28 comprises an SAE standard J2534 device, such as a device compliant with the J2534-2 standard. Interface tool 28 includes hardware and software and, as a result of new vehicles and changes to existing vehicles, from time-to-time the software of interface tool 28 needs to be upgraded, such as via the Internet or by way of a direct download from a connected computer. Still further, the hardware of interface tool 28 may additionally need to be updated as a result of the development of new vehicles or changes to existing vehicles.

It should be appreciated that interface tool 28 is a complex and costly product, including in part due to being adapted for use with multiple vehicles, and that tool 28 may require updates to software and/or hardware. Some service and repair centers may experience difficulty with ownership of an interface tool 28, both in terms of cost and maintenance of the interface tool 28. However, due to the wide use of OBD systems in vehicles, it is important that service and repair centers have access to interface tools 28 that are fully updated for use in servicing vehicles, including because without this ability service and repair centers may be unable to properly service vehicles. The present interface tool 28 advantageously enables a service technician 24 to incur costs for the use of interface tool 28 only when necessary, thus avoiding the need to purchase an interface tool outright or pay for a subscription even when the interface tool 28 is not being used. The ability to allocate expenses for predefined uses additionally enables charges for such services to be readily passed thru to the consumer.

Referring now to FIGS. 2 and 3, in addition to operator interface 48, interface tool 28 is additionally illustrated to include a USB port 54 for connection to computer 30 via a cable, a 26-pin port 56 for connection to the OBD port 32 of vehicle 22 via cable 42, and a light 58*a* for indicating power to the device, as well as lights 58*b* and 58*c* for indicating communication connections with the vehicle 22 and computer 30, respectively. Also included is a vehicle cable indicator light 58*d*. Power to interface tool 28 may be supplied via a separate connection, or may be supplied via computer 30 through the connection of inter face tool 28 with computer 30.

In the illustrated embodiment operator interface 48 comprises a screen 60 and touch pad 62, whereby operator 24 is able to activate interface tool 28 via touch pad 62. For example, interface tool 28 may be supplied to operator 24 with one or more predetermined number of allowed and prepaid activations. By entry of a code via touch pad 62, operator 24 may activate interface tool 28 for use in diagnosing and/or programming a vehicle 22. Still further, touch pad 62 may enable entry of specifics related to the vehicle 22 that is to be worked on by operator 24, such as vehicle make, model and/or year, with the activation being based thereon. Interface tool 28 may include nonvolatile memory for tracking the number of activated uses of interface tool 28 relative to the predetermined number of allowed or authorized activations. Upon operator 24 using interface tool 28 for the predetermined number of allowed activations, interface tool 28 will be internally prevented from further activation, even when power is supplied to interface tool 28 and interface tool 28 is connected with computer 30 and vehicle 22.

Alternatively, interface tool 28 may be configured for activation upon entry of a code supplied to an operator 24 without interface tool 28 being supplied with a predetermined number of allowed activations. For example, operator 24 may contact a supplier of interface tool 28 to acquire an access code, such as via a purchase, with interface tool 28 configured to accept authorized access codes entered by an operator 24. In this embodiment a repair or service facility need only pay for the ability to activate interface tool 28 at such times when use of tool 28 is required. It should be appreciated that in this embodiment interface tool 28 need not be connected with a remote computer for activation, but instead includes hardware and software, such as nonvolatile memory and encrypted programs, that allow interface tool 28 to be externally activated.

It should be appreciated that interface tool 28 is able to decipher the make and model of the vehicle 22 being diagnosed and/or reprogrammed. Interface tool 28 may additionally be able to ascertain the vehicle identification number ("VIN") of the vehicle 22. As such, interface tool 28, upon an activation and connection with a given vehicle, may be configured to enable or allow the diagnosing and/or reprogramming for the specific vehicle based on the data ascertained by interface tool 28. In such case, interface tool 28 may prevent its further operation upon interface tool 28 being connected with a different vehicle and the detection thereof.

Still further, interface tool 28 may be selectively connected with a remote computer 64, such as a server of the supplier of interface tool 28, for enabling activation of interface tool 28. As understood from FIG. 1, connection of interface tool 28 with remote computer 64 may be by way of computer 30 via an Internet 66. In this embodiment operator 24 may activate interface tool 28 for use by connecting with remote computer 64, whereby remote computer 64 supplies an activation signal or message to interface tool 28 to thereby activate interface tool 28 for use by operator 24. In a particular embodiment, interface tool 28 receives the activation signal in volatile memory of interface tool 28, whereby upon interface tool 28 being removed from power, interface tool 28 becomes deactivated whereby it can no longer be used for diagnosing and/or reprogramming of a vehicle until interface tool 28 is reactivated. Alternatively, interface tool 28 may include nonvolatile memory whereby connection of interface tool 28 with remote computer 64 may be performed to authorize inter face tool 28 for a predetermined number of uses and/or enable inter face tool 28 to resume operation upon disconnecting from power without the need for obtaining a reactivation signal.

It should be appreciated that operator interface 48 may not be required in embodiments in which interface tool 28 is connectable to a remote computer 64. Alternatively, interface tool 28 may itself include an Internet interface 68, with operator interface 48 being used to connect to remote computer 64 for enabling activation of interface tool 28. Still further, an interface tool 28 may be provided that does not include an operator interface 48, but instead receives activation information from an operator 24 via a local computer 30 without connecting to a remote computer 64, where entry and display of information would be by way of computer 30 instead of via an operator interface 48.

Figure 4:
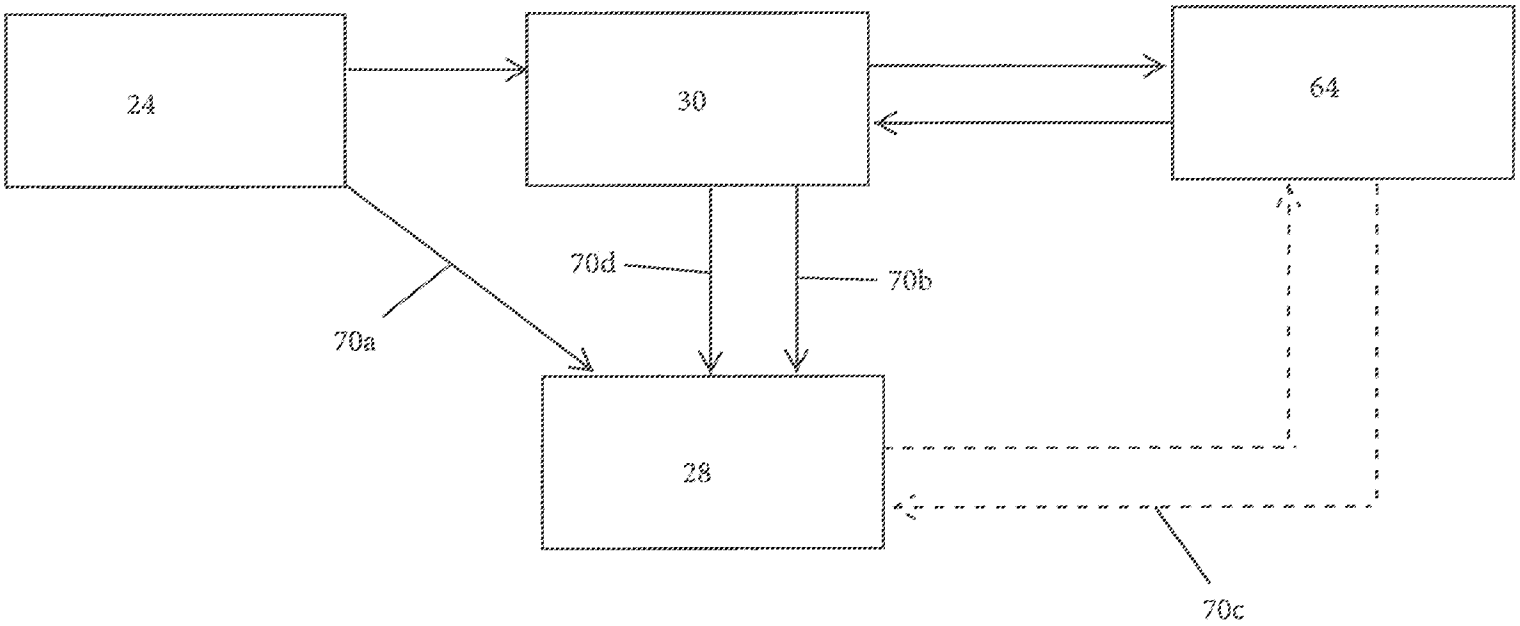
FIG. 4 is a schematic illustration of the supplying of activation signals to a vehicle programming and diagnostic interface device in accordance with the present invention.

Interface tool 28 is thus selectively activated upon obtaining or receiving an activation message or signal, with the operation of interface tool 28 being limited in accordance with a predefined limited use. Accordingly, interface tool 28 is inoperable for use in diagnosing and/or programming a vehicle unless activated, even when power is supplied to interface tool 28 and interface tool 28 is connected with vehicle 22 via port 32. As understood with reference to FIG. 4, an activation message 70*a* may be generated via the entry of a code by operator 24 to interface tool 28, such as to an operator interface 48. Alternatively and/or additionally, an activation message 70*b* may be generated via a remote computer 64 and supplied to the interface tool 28, such as through a local computer 30. Alternatively, an activation message 70*c* may be supplied directly to the interface tool 28 from a remote computer 64. Still further, an activation message 70*d* may be supplied or entered to the interface tool 28 from the local computer 30 without the need for accessing a remote computer 64.

As noted, interface tool 28 may be operated in accordance with various predefined limited use parameters. For example, a predefined limited use may be for a single use or activation, wherein each time interface tool 28 is to be utilized an activation message or signal must be supplied to interface tool 28 to enable operation. Moreover, the single use or single activation may encompass the use of interface tool 28 for a single vehicle. For example, interface tool 28 is operable to detect when it is in operative communication with a vehicle upon being connected with port 32, such as by way of receiving vehicle information, such as in the form of signals from one or more of the ECUs. Interface tool 28 may be configured to utilize such detection as a trigger as an activation signal for a single use, thereby allowing information to be exchanged between the vehicle 22, interface tool 28 and/or computer 30, whereupon the disconnecting of interface tool 28 from port 32 the single use would be complete and interface tool 28 would be disabled from being operable to diagnose and/or program. It should be appreciated that interface tool 28 could be pre-configured for multiple uses in this manner, with control 29 monitoring the number of activations resulting from distinct connections with vehicles and disabling further operation to diagnose and/or program vehicles upon reaching the number of pre-configured uses.

Alternatively, the detection of a connection with a vehicle after having received a separate activation signal, such as input via operator interface 48 or from computer 30, may be used as confirmation that an authorized use was engaged in by operator 24, whereby control 29 would disable the operable use of interface tool 28 to diagnose and/or program vehicles upon completion of that use and until receipt of a further activation signal.

As a still further alternative, the predefined use may be for a preset time duration, such as, for example, a set number of hours or days regardless of the number of vehicles. It should be appreciated that in the embodiment of a single activation based on a preset time duration that the interface tool 28 may be configured to remain "activated" even after power has been removed. For example, if the preset time duration is for a period of five days, interface tool 28 may be powered down at the end of each day, but would still be useable to diagnose and/or reprogram vehicles after being repowered when still within the preset time duration. The same activation message may be supplied to interface tool 28 each time the device is to be used in the case of a preset time duration extending over a predetermined time limit. Control 29 may, for example, track the length of the time of use of interface tool 28.

Still further, interface tool 28 may be preconfigured, such as within control 29, to enable a given or preset number of activations, where each activation is generated upon supplying a different activation message to interface tool 28. Each separate activation may be for a preset time period, or may be for a predetermined number of uses, such as a single use with a given vehicle, or multiple discrete uses.

In the illustrated embodiment operator interface 48 is disclosed as a screen 60 and touchpad 62. It should be appreciated that alternatively configured operator interface configurations may be employed within the present invention. For example, an operator interface may be configured as a touch screen, or may include push buttons.

Figure 5:
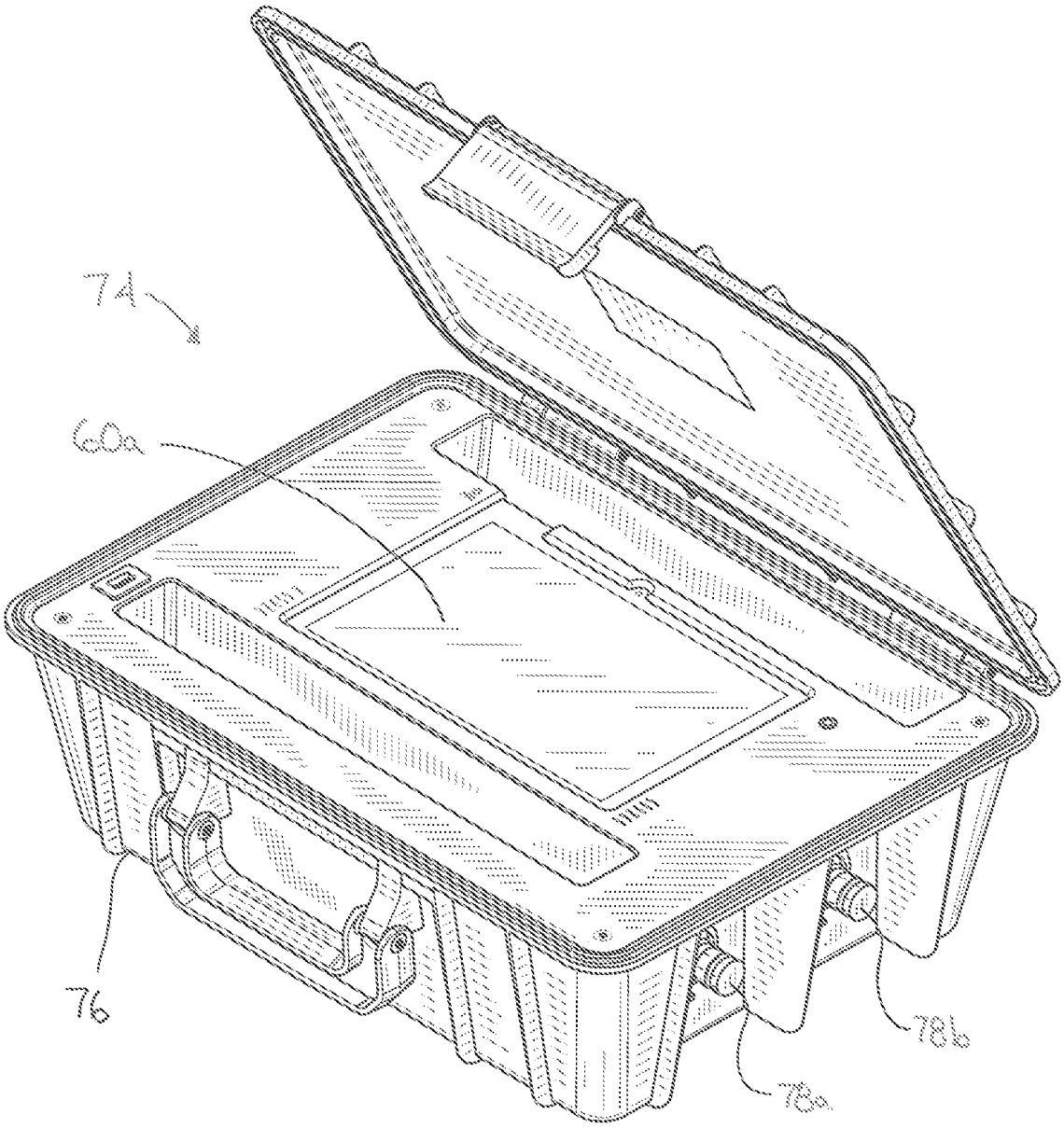
FIG. 5 is a perspective view of an alternative embodiment of the present invention in which a vehicle programming and diagnostic interface device is integrated into a vehicle maintenance computer system.

In the above discussed embodiments, vehicle interface tool 28 and computer 30 are shown as separate components that are linked together, such as by way of a cable 72. In an alternative embodiment, however, interface tool 28 and computer 30 may be integrated together to operate as a vehicle maintenance computer system, as indicated by reference number 74 in FIG. 1. With reference to FIG. 5, for example, a computer system 74 may comprise a case or housing 76 within which an interface tool and computer are integrated. In such an embodiment cable 42 would then connect to port 32 of vehicle 22 from the housing 76 of system 74, such as from a port in or on housing 76, with an operator 24 interacting with system 74 by way of screen 60*a*. Vehicle maintenance computer system 74 may optionally further include an integrated battery charger whereby posts 78*a*, 78*b* may be used to maintain power to vehicle 22 during reprogramming of the ECUs of vehicle 22 and/or while using system 74 to diagnose vehicle 22.

Although interface tool 28 is discussed above as conforming with the SAE J2534 standard it should be appreciated that alternatively configured vehicle diagnostic and programming tools may be employed within the scope of the present invention, including alternatively configured tools for alternative types of vehicles, such as alternative classes of vehicles. Accordingly, an interface tool may conform with the ISO 22900 standard, or RP1210 standard, or may operate under the ELM327 command protocol.

As noted, the software and/or hardware of diagnostic and programming tools may be required to be updated to operate with new vehicles and/or enable programming and diagnosing of existing vehicles. In the above noted embodiments the interface tool 28 may be periodically updated via an Internet connection, such as via computer 30, or may be returned to the supplier for updating, including with regard to hardware updates. This may be done by the supplier of the interface tool 28 whereby the local operator 24 need not spend time attempting to maintain the equipment. It should be appreciated that the ability to selectively pay for and use an interface device in accordance with the present invention beneficially aids service and repair facilities in avoiding to invest significant capital in ownership and maintenance of a traditional interface tool. This, for example, is beneficial for smaller and/or independent facilities that may only intermittently require use of an interface tool. Thus, a supplier may provide a vehicle interface tool, either alone or as part of a vehicle maintenance computer system, for programming and/or diagnosing a vehicle whereby the local operator need not incur the expense of purchasing and maintaining such a device. The operator then needs only to pay for uses of the device as needed.

Changes and modifications in the specifically described embodiments can be carried out without departing from the principles of the present invention which is intended to be limited only by the scope of the appended claims, as interpreted according to the principles of patent law including the doctrine of equivalents.

The embodiments of the invention in which an exclusive property or privilege is claimed are defined as follows:

1. A method of diagnosing and/or programming a vehicle at a repair facility comprising:

providing a vehicle interface device at the repair facility, said vehicle interface device configured to operate for diagnosing and programming at least one electronic control unit of one or more of a plurality of vehicles of one or more different makes and models at the repair facility via communication with a diagnostic application, wherein said vehicle interface device includes one or more vehicle protocols to enable communication with electronic control units of the one or more different makes and models of vehicles when said vehicle interface device is connected with a diagnostic port thereof, and wherein said vehicle interface device operates on a predetermined use basis upon receiving an activation signal;

connecting said vehicle interface device with a diagnostic port of a vehicle at the repair facility to be in communication with an electronic control unit of the vehicle;

supplying electrical power to said vehicle interface device;

selectively transmitting the activation signal to said vehicle interface device thereby enabling said vehicle interface device to diagnose and/or program the electronic control unit of the vehicle via communication with the diagnostic application for a predetermined use;

operably establishing communication between said vehicle interface device and the diagnostic application, wherein said vehicle interface device is only operable for diagnosing and programming the electronic control unit when enabled by the activation signal and in communication with the diagnostic application;

disconnecting said vehicle interface device from the diagnostic port of the vehicle at the repair facility upon completion of diagnosing and/or programming of the electronic control unit of the vehicle at the repair facility; and disabling operation of said vehicle interface device to diagnose and program a vehicle upon said vehicle interface device operating for the predetermined use.

2. The method of claim 1, wherein said predetermined use basis comprises a timer based predetermined use limiting operation of said vehicle interface device to diagnose and/or program vehicles to a predetermined duration of time.

3. The method of claim 2, wherein said method further comprises removing electrical power to said vehicle interface device after enabling said vehicle interface device and prior to said vehicle interface device operating for the predetermined use, and wherein said method further comprises subsequently re-supplying electrical power to said vehicle interface device and allowing said vehicle interface device to be operable to diagnose and/or program a vehicle to completion of the predetermined use.

4. The method of claim 1, wherein said predetermined use basis comprises a predetermined number of uses of said vehicle interface device to diagnose and/or program vehicles.

5. The method of claim 4, further comprising communicating signals from the electronic control unit to said vehicle interface device and detecting with said vehicle interface device that said vehicle interface device is connected to the vehicle via said communicating signals.

6. The method of claim 5, wherein said detecting with said vehicle interface device comprises confirmation that said vehicle interface device is enabled to diagnose and/or program the vehicle.

7. The method of claim 1, wherein said vehicle interface device includes an operator interface, and wherein said transmitting an activation signal to said vehicle interface device comprises manually entering an activation signal via said operator interface.

8. The method of claim 1, wherein said method further comprises providing a computer, said computer being operatively connected with said vehicle interface device, and wherein said transmitting an activation signal to said vehicle interface device comprises transmitting an activation signal from said computer to said vehicle interface device.

9. The method of claim 8, wherein said method further comprises connecting said computer to a remote computer, and transmitting an activation signal from said remote computer to said computer.

10. The method of claim 1, wherein said method further comprises providing a computer at the repair facility, said computer including the diagnostic application and being operatively connected with said vehicle interface device.

11. The method of claim 1, wherein said method further comprises providing a computer at the repair facility, wherein said method further comprises connecting said computer to a remote computer and wherein the remote computer includes the diagnostic application.

12. The method of claim 1, wherein the diagnostic application is selected from a plurality of diagnostic applications based at least upon the make and model of the vehicle to be diagnosed and/or programmed.

13. A method of diagnosing and/or programming a vehicle at a repair facility comprising:

providing a vehicle interface device at the repair facility, said vehicle interface device configured to operate for diagnosing and programming at least one electronic control unit of one or more of a plurality of vehicles of one or more different makes and models at the repair facility via communication with a diagnostic application, wherein said vehicle interface device includes one or more vehicle protocols to enable communication with electronic control units of the one or more different makes and models of vehicles when said vehicle interface device is connected with a diagnostic port thereof, and wherein said vehicle interface device operates on a predetermined use basis;

connecting said vehicle interface device with a diagnostic port of a vehicle at the repair facility to be in communication with an electronic control unit of the vehicle;

supplying electrical power to said vehicle interface device;

selectively enabling said vehicle interface device to be operable to diagnose and/or program the electronic control unit of the vehicle via communication with the diagnostic application for a predetermined use;

operably establishing communication between said vehicle interface device and the diagnostic application, wherein said vehicle interface device is only operable for diagnosing and programming the electronic control unit when enabled and in communication with the diagnostic application;

disconnecting said vehicle interface device from the diagnostic port of the vehicle at the repair facility upon completion of diagnosing and/or programming of the electronic control unit of the vehicle at the repair facility; and disabling operation of said vehicle interface device to diagnose and program a vehicle upon said vehicle interface device operating for the predetermined use.

14. The method of claim 13, wherein said predetermined use basis comprises a timer based predetermined use limiting operation of said vehicle interface device to diagnose and/or program vehicles to a predetermined duration of time.

15. The method of claim 14, wherein said method further comprises removing electrical power to said vehicle interface device after enabling said vehicle interface device and prior to said vehicle interface device operating for the predetermined use, and wherein said method further comprises subsequently re-supplying electrical power to said vehicle interface device and allowing said vehicle interface device to be operable to diagnose and/or program a vehicle to completion of the predetermined use.

16. The method of claim 13, wherein said predetermined use basis comprises a predetermined number of uses of said vehicle interface device to diagnose and/or program vehicles.

17. The method of claim 16, further comprising communicating signals from the electronic control unit to said vehicle interface device and detecting with said vehicle interface device that said vehicle interface device is connected to the vehicle via said communicating signals, and wherein said detecting with said vehicle interface device comprises confirmation that said vehicle interface device is enabled to diagnose and/or program the vehicle.

18. The method of claim 13, wherein said vehicle interface device includes an operator interface, and wherein said selectively transmitting an activation signal to said vehicle interface device thereby enabling said vehicle interface device to be operable to diagnose and/or program a vehicle comprises transmitting an activation signal to said vehicle interface via said operator interface.

19. The method of claim 18, wherein said transmitting an activation signal to said vehicle interface comprises manually entering an activation signal via said operator interface.

20. The method of claim 13, wherein said method further comprises providing a computer, said computer being operatively connected with said vehicle interface device, and wherein said selectively transmitting an activation signal to said vehicle interface device thereby enabling said vehicle interface device to be operable to diagnose and/or program a vehicle comprises transmitting an activation signal to said vehicle interface device from said computer.

21. The method of claim 20, wherein said method further comprises connecting said computer to a remote computer, and transmitting an activation code from said remote computer to said computer.

22. The method of claim 13, wherein the diagnostic application is selected from a plurality of diagnostic applications based at least upon the make and model of the vehicle to be diagnosed and/or programmed.

23. A vehicle diagnostic and/or programming system, said system comprising:

a vehicle interface device, said vehicle interface device including a control, one or more vehicle protocols to enable communication with the electronic control units of one or more different makes and models of vehicles when operatively connected with a vehicle, and a computer interface;

wherein said vehicle interface device is operable to selectively diagnose and program electronic control units of one or more of a plurality of vehicles via communication with a diagnostic application on a predetermined use basis when said vehicle interface device is selectively activated for the predetermined use basis and operatively connected with the vehicle and operatively in communication with said diagnostic application, and wherein said vehicle interface device is configured to cease being operable to diagnose and program a vehicle via communication with said diagnostic application upon said vehicle interface device operating for the predetermined use basis.

24. The system of claim 23, further including a computer, said computer including said diagnostic application and being operatively connected with said vehicle interface device with said computer configured to enable an operator to diagnose and/or program the vehicle via said vehicle interface device.

25. The system of claim 24, wherein said vehicle interface device and said computer are integrated together.

26. The system of claim 24, wherein said computer comprises an internet interface.

27. The system of claim 23, wherein said vehicle interface device includes an operator interface, and wherein said operator interface comprises at least one of a screen and a touchpad configured for use by an operator.

* * * * *